United States Patent [19]

Amemiya et al.

[11] Patent Number: 4,912,515

[45] Date of Patent: Mar. 27, 1990

[54] IMAGE FORMING APPARATUS

[75] Inventors: Koji Amemiya; Takeshi Menjo, both of Tokyo; Takashi Hasegawa, Warabi; Hiroshi Satomura, Hatogaya, all of Japan

[73] Assignee: Canon Kabushiki Kaisha, Tokyo, Japan

[21] Appl. No.: 372,170

[22] Filed: Jun. 27, 1989

Related U.S. Application Data

[63] Continuation of Ser. No. 216,120, Jul. 7, 1988, abandoned.

[30] Foreign Application Priority Data

Jul. 9, 1987 [JP] Japan ..... 62-171653

[51] Int. Cl.[4] ..... G03G 15/02; G03G 15/01

[52] U.S. Cl. ..... 355/274; 355/326; 355/315; 355/222

[58] Field of Search ..... 355/274, 271, 315, 276, 355/326, 222, 221; 361/225

[56] References Cited

U.S. PATENT DOCUMENTS

| | | | |
|---|---|---|---|
| 3,877,416 | 4/1975 | Donohue et al. | 118/647 X |
| 4,076,407 | 2/1978 | Place | 355/14 TR |
| 4,134,147 | 1/1979 | Watanabe | 355/14 TR |
| 4,401,383 | 8/1983 | Suzuki et al. | 355/14 TR |
| 4,449,808 | 5/1984 | Abreu | 355/14 CH |
| 4,536,082 | 8/1985 | Motohashi et al. | 355/14 TR |
| 4,640,606 | 2/1987 | Inamoto | 355/14 TR |
| 4,676,627 | 6/1987 | Ohno | 355/14 CH |

FOREIGN PATENT DOCUMENTS

| | | | |
|---|---|---|---|
| 52-67643 | 6/1977 | Japan . | |
| 54-34834 | 3/1979 | Japan . | |
| 135965 | 8/1982 | Japan . | |
| 57-197579 | 12/1982 | Japan | 355/14 TR |
| 61-140970 | 6/1986 | Japan | 355/14 TR |
| 282861 | 12/1986 | Japan . | |
| 85772 | 4/1988 | Japan . | |

*Primary Examiner*—R. L. Moses

*Attorney, Agent, or Firm*—Fitzpatrick, Cella, Harper & Scinto

[57] ABSTRACT

An image forming apparatus includes a movable image bearing member, a device for sequentially forming on the image bearing member images corresponding to different color information, a device for transferring onto an image receiving material the images formed on the image bearing member, image receiving material carrying member for carrying and conveying the image receiving material to an image transfer station where the image bearing means and the transfer device are opposed, wherein the images formed on the image bearing member are sequentially transferred superimposedly onto the image receiving material at the transfer station, a discharging device disposed downstream of the image transfer device with respect to movement detection of the image receiving material carrying member, a detector for detecting a temperature and a humidity within the image forming apparatus, and a control device for controlling outputs of the image transfer device and the discharging device on the basis of output from the detector and predetermined data.

20 Claims, 8 Drawing Sheets

| AMBIENCES | REPRESE NTATIVE | | TRANSFER CURRENT (μA) | | | | DISCHARGE VOLT. (KV PEAK TO PEAK) |
|---|---|---|---|---|---|---|---|
| | TEMP. (%) | HUMIDITY (%) | Y | M | C | Bk | |
| 1 | 10 | 10 | 400 | 530 | 660 | 790 | 12.0 |
| 2 | 15 | 30 | 320 | 420 | 520 | 620 | 11.0 |
| 3 | 20 | 45 | 230 | 330 | 430 | 530 | 10.0 |
| 4 | 25 | 60 | 180 | 260 | 340 | 420 | 8.0 |
| 5 | 30 | 70 | 120 | 190 | 260 | 330 | 4.0 |
| 6 | 35 | 90 | 100 | 150 | 200 | 250 | — |

FIG. 7

IMAGE FORMING APPARATUS

This application is a continuation of application Ser. No. 216120 filed Jul. 7, 1988, now abandoned.

FIELD OF THE INVENTION AND RELATED ART

The present invention relates to an image forming apparatus such as an electrophotographic copying apparatus or an electrostatic recording apparatus, more particularly to a color image forming apparatus such as a multi- or full-color electrophotographic copying apparatus provided with a plurality of developing devices and to various color printers such as a recording apparatus constituting output machines for a facsimile machine, computer and the like. In the following description, a multi- or full-color electrophotographic machine will be taken up as an exemplary color image forming apparatus.

In the field of multi-color electrophotographic machines, there have been made various proposals. Among them, there are recent proposals employing movable type developing devices with the view of reducing the size of a photosensitive drum.

Referring first to FIG. 3, there is shown a multi color or full color electrophotographic machine provided with a developing device of the so-called rotary type which is one of the movable type developing devices. The general description of a multi- or full-color electrophotographic machine is as follows.

A photosensitive drum 1, which is an image bearing member, is rotatably supported at a position adjacent to a center of the apparatus. To the left of the photosensitive drum 1, there is disposed a rotary type developing device 4, and to the bottom of the photosensitive drum 1, a transfer drum 5 is disposed which is rotatably supported on the apparatus.

The rotary developing device 4 is provided with four developing devices 4Y, 4M, 4C and 4BK which respectively contain a yellow developer, a magenta developer, a cyan developer and a black developer, and with a substantially columnai or cylindrical casing **4*a* which supports the four developing devices 4Y, 4M, 4C and 4BK and which is rotatably supported on the apparatus. The rotary type developing apparatus 4 provides a developing station wherein the developing devices are adapted to be opposed to the photosensitive drum 1 surface, with the respective developing devices by rotation of the casing 4*a*, so that the electrostatic latent images are developed with the developers having the colors corresponding to the electrostatic latent images. By one full turn rotation of the casing 4*a*, a full color image development with four colors is performed. The casing 4*a* is driven by a driving source M1. The transfer drum 5 includes a cylinder 5*a* having a cut-away portion, a transfer material supporting sheet 50 made of a film such as a polyethylene terephthalate film or the like, and expanded to cover the cut away portion of the cylinder 5*a*, and a gripper 5*c* for gripping the leading edge of the transfer material. Inside the transfer drum 5, there is disposed a transfer charger 5*b* in opposition to the photosensitive drum 1. Downstream thereof, there is provided a couple of dischargers (an inside discharger 5*d* and an outside discharger 5*e*) with the circumference of the transfer drum 5** therebetween. A reference T designates an image transfer station.

Around the photosensitive drum 1, there are provided, in addition to the rotary type developing device 4 and the transfer drum 5, a corona charger 2 for uniformly charging the photosensitive drum 1 and image exposure means 3 for projecting onto the photosensitive drum 1 light information bearing image information to be recorded or printed. As for the image exposure means 3, the type shown in FIG. 3 (slit exposure) or a laser beam scanning means is usable. Further, cleaning means is provided to removing from the outer surface of the photosensitive drum 1 the toner which has been supplied from the developing devices 4Y, 4M, 4B and 4BK and which has remained thereon.

The multi color electrophotographic apparatus shown in FIG. 3 is provided with a detachably mountable cassette 7 accommodating transfer materials. The apparatus further comprises a conveying system 8 for conveying the transfer material from the cassette 7 to the transfer drum 5, and a conveying system 10 for further conveying the transfer material after it is separated from the transfer drum 5. The transfer material conveyed by the conveying system 10 is introduced into a heat roller fixing device 11, by which the image is fixed on the transfer material, and the transfer sheet is discharged onto a discharge tray 12.

The operation of the multi-color electrophotographic apparatus described above is performed in the following manner to form a full color image. The photosensitive drum 1 is uniformly charged by the corona charger 2, and is exposed to image information light by the exposure means 3 so that a first color-separated electrostatic latent image is formed thereon. The latent image is developed by a yellow developer accommodated in the yellow developer 4Y, for example. On the other hand, the transfer material in the cassette 7 is conveyed out thereof and to the transfer drum 5 by the conveying system 8. The transfer material conveyed to the transfer drum 5 is gripped by the gripper **5*c*. By rotation of the transfer drum 5, the transfer material is conveyed to the transfer station T, where the visualized (developed) image on the surface of the photosensitive drum 1 is transferred onto the transfer material by the operation of the transfer charger 5*b*, and simultaneously, the transfer material is electrostatically attracted to the transfer material carrying sheet 50**.

In the similar manner, second, third and fourth color-separated electrostatic latent images are sequentially formed on the photosensitive drum 1, and the electrostatic latent images are developed sequentially by the magenta, cyan and black developers, respectively. The visualized images of the three colors are sequentially superimposedly transferred onto the transfer material carried on the transfer drum 5.

Upon completion of the superimposed transfer of the four color visualized images, the transfer material is separated from the transfer material carrying sheet 50 of the transfer drum 5 by the separating means 9, and is conveyed to the image fixing device 11 through the conveying system 10. Finally, the transfer material is discharged onto the tray 12. In this manner, a full-color image is formed on the transfer material. When the transfer material is separated from the transfer material carrying sheet 50, the couple of dischargers **5*d* and 5*e* is operated to weaken the electrostatic attraction force between the transfer material carrying sheet 50** and the transfer material.

In the image transferring operations, the transfer current is so controlled as to be sequentially increased with the repetition of the image transfer from the photosensitive drum 1 to the visualized image by the respective developers. The reason for this is as follows. In the first image transfer operation, the current $I_1$ is supplied, by which the transfer material carrying sheet 50 (FIG. 8) is charged to potential $V_1$ by the current $I_1$, while the visualized image on the photosensitive drum 1 is transferred onto the transfer material. The transfer material is retained on the transfer material carrying sheet 50 by the gripper 5*c*, and is moved in synchronism with the photosensitive drum 1 by the rotation of the photosensitive drum 5 at the same peripheral speed as the photosensitive drum 1. When the transfer material is separated from the photosensitive drum 1 after receiving the visualized image from the photosensitive drum 1, the adjacent air is ionized. Assuming that the toner particles of the respective developers are charged to negative polarity, whereas the transfer voltage of the transfer charger 5*b* is set to positive polarity, the negative ions of the ionized air are deposited onto the surface of the transfer material, whereas the positive ones are deposited onto the outer surface of the photosensitive drum 1. The negative charge deposited on the transfer material influences the positive charge which has been deposited onto the back side of the transfer material carrying sheet 50 by the transfer current, and as a whole, the transfer electric field provided by the transfer current is weakened. On the other hand, since the toner which has been transferred onto the transfer material from the photosensitive drum 1 in the form of a visualized image, is negatively charged, the transfer electric field is further weakened. In order to compensate for the weakening and to provide a proper transfer electric field, it is required that the transfer current supplied to the transfer charger 5*b* is increased, in the next image transfer operation.

The relation between the transfer current and the potential of the transfer material carrying sheet 50 will be described. When the plurality of the transfer voltage is positive, $I_1<I_2$, and $V_1<V_2$, where $I_2$ is a transfer current upon the second image transfer action, and $V_2$ is a potential of the transfer material carrying sheet 50 by the transfer current $I_2$. It is desirable that the potentials $V_2$ and $V_1$ of the transfer material carrying sheet 50 satisfy $|V_2-V_1|>0.5$ KV. And, it is desirable that the similar relation is satisfied in the third and subsequent image transfer operation.

In the conventional apparatus, in order to apply a transfer electric field to the transfer material carrying sheet 50, the transfer current supplied to the transfer charger 5*b* is so controlled that the difference, depending on the number of transfer operations, is constant over a predetermined usable temperature range. However, when the ambient conditions in the place where the electrophotographic apparatus is placed is changed, particularly in a high temperature and high humidity condition, the volume resistivity of the transfer material, particularly when it is of paper, decreases to approximately 1/100 of the volume resistivity at normal temperature and humidity (23° C., 60%, for example). Also, the surface resistance of the transfer material carrying sheet 50 decreases. Therefore, if the image is transferred with the transfer current controlled above, a so-called nontransfer spot, which is produced when the transfer electric field is too strong, is easily produced.

If, on the contrary, the ambient conditions are changed to a low temperature and low humidity condition, the volume resistivity of the transfer paper increases up to that under the normal conditions multiplied by 100. The surface resistance of the transfer material carrying sheet 50 decreases as by the amount of water deposited on the surface of the transfer material carrying sheet 50 increases. Therefore, the transfer current at the n-th current is not property discharged by the time of the (n+1)th color transfer, with the result that the charge is sequentially accumulated. Accordingly, with the transfer current set in the manner described above, the transfer efficiency decreases so that the image quality is not sufficient.

For the purpose of solving this problem, it is considered to employ a humidity sensor to detect the humidity of the ambience in which the multi color electrophotographic apparatus is placed, and in response to the detected humidity, the set level of the transfer current is changed. However, generally used humidity sensors such as a crystal humidity sensor, a high polymer humidity sensor and ceramics humidity sensor, detect the relative humidity of the ambience in which the humidity sensor is employed and produces an electric signal indicative of the detected relative humidity. Therefore, it is not possible to detect an amount of water contained in the ambience which is contributable to the variation in the resistance of the transfer paper.

Referring to FIG. 9, the reason for this will be explained. FIG. 9 is a graph of an amount of water contained in the ambience (saturated amount) per unit volume thereof, calculated from a saturated vapor pressure vs. temperature. The scale of the amount of the water is such that it is 100 (relative scale) at 30° C. For example, when the amount of water in the ambience is 100 at 30° C., any of the above described humidity sensors produces a voltage signal representative of 100% of relative humidity; and when the amount of the water is 50, it produces a voltage signal indicative of 50% of the relative humidity. As will be understood from FIG. 9, the saturated amount of water in the air is approximately 31 at the temperature of 10° C. Under these conditions, the humidity sensor produces a voltage signal representative of 100% of the relative humidity. If the amount of water is approximately 31 at the temperature of 30° C., the humidity sensor produces a voltage signal representative of the relative humidity of 31%. As will be understood, any of the above humidity sensors produces different relative humidities depending on the temperature of the ambience even if the amount of water is the same.

However, the volume resistivity of the transfer sheet and the surface resistance of the transfer material carrying sheet 50 are dependent on the amount of water in the ambient atmosphere. Therefore, to read only the output signal from the humidity sensor having such output characteristics, is not proper for the purpose of such a control that the transfer current set is increased under low humidity conditions, while it is decreased under high humidity conditions.

Referring to FIG. 10, there is shown a dependency of the volume resistivity of the transfer sheet upon the amount of water in the air or ambience or upon the amount of water contained in the transfer sheet. The amount or content of water in the paper sheet is the amount per unit volume of the sheet.

A proposal has been made, as in U.S. application Ser. No. 558,006 now U.S. Pat. No. 4,676,627 which has been assigned to the assignee of this application, wherein the above described transfer current control is not used, and wherein outputs of a pair of the dischargers are controlled in response to the output of a humidity sensor. However, even in this case, proper discharging current is not always provided to compensate for variations in ambient conditions, for the same reasons as with the above described transfer current control. Therefore, when the transfer material is separated from the transfer drum, it sometimes separated improperly, or the visualized image on the transfer material is disturbed.

SUMMARY OF THE INVENTION

Accordingly, it is a principal object of the present invention to provide an image forming apparatus wherein improper image transfer attributable to variation in ambient conditions is prevented, so that good images can be produced at all times.

It is another object of the present invention to provide an image forming apparatus wherein an image receiving material is separated from an image receiving material carrying means, improper separation attributable to variation in the ambient conditions and/or disturbance occurred to the transferred image carried on the image receiving material, is prevented.

It is a further object of the present invention to provide an image forming apparatus wherein even if an image forming operation is performed after time elapses after continuous or intermittent image forming operations are performed from the start of the image forming operation upon actuation of the power switch, an improper image transfer does not occur, so that good images can be provided.

It is a further object of the present invention to provide a full color image forming apparatus wherein a high quality full-color image can be produced at all times.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a table of data for the transfer currents and the discharging voltages for the respective ambient conditions, stored in the memory shown in FIG. 2.

DETAILED DESCRIPTION OF THE PREFERRED EMBODIMENTS

The preferred embodiments of the present invention will be described in conjunction with the accompanying drawings. Although, the image forming apparatus of the present invention has various applications, the following description will be made with respect to a multicolor electrophotographic apparatus as an exemplary image forming apparatus, which is similar to the FIG. 3 apparatus and which, however, incorporates the present invention. The general structure and operation of the apparatus is therefore similar to those described above with FIG. 3, and the detailed description thereof is omitted.

Figure 1:
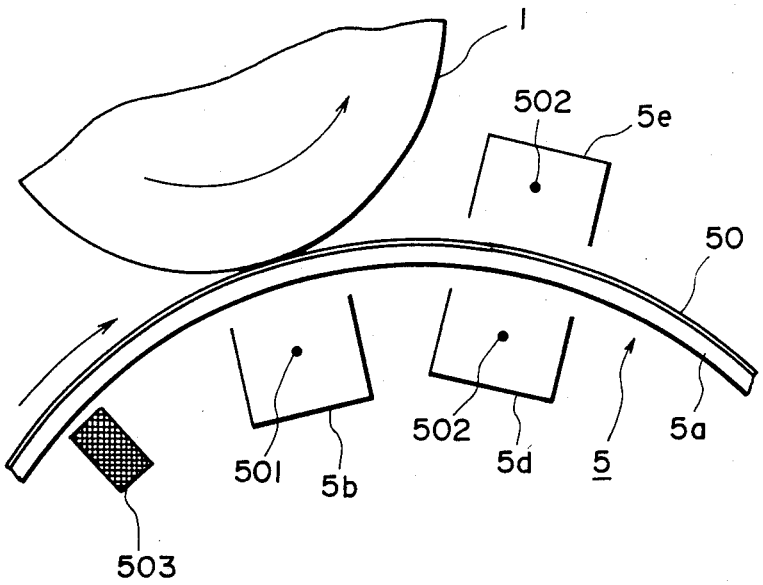
FIG. 1 is a partial longitudinal sectional view of an image forming apparatus according to an embodiment of the present invention, at a transfer station.
Figure 3:
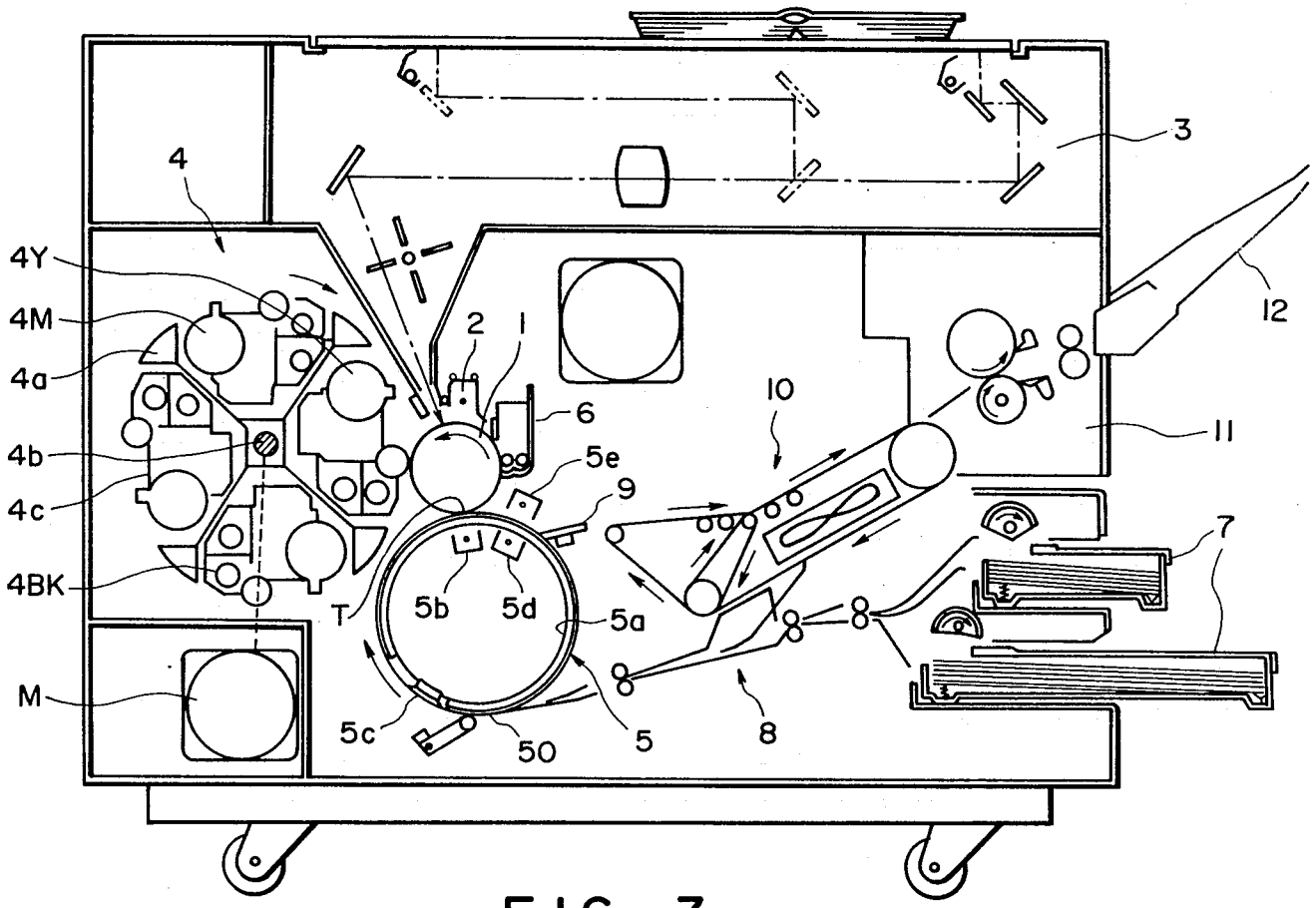
FIG. 3 is a sectional view of an image forming apparatus to which the present invention is applicable.

Referring to FIG. 1, there is shown a structure adjacent a transfer station of an image forming apparatus according to the present invention having a general structure similar to that of the FIG. 3 apparatus. In FIG. 1, the transfer charger 5*b* is provided with an opening for the charging having a width of 22 mm, wherein the distance between the corona discharging wire 501 and the outer surface of the photosensitive drum 1 is 11 mm. In the couple of dischargers 5*d* and 5*e*, the widths of the discharging openings and the distances between the corona discharging wire 502 and the transfer material carrying sheet (dielectric sheet) 50 are the same. In this embodiment, the dischargers 5*d* and 5*e* are AC corona dischargers, wherein the phase of the discharger 5*d* is opposite to that of the discharger 5*e*. The transfer material carrying sheet 50 stretched to cover the opening of the transfer drum 5 cylinder 5*a* constitutes a cylinder having a diameter of 160 mm, and the speed of movement is 160 mm/sec. On the other hand, the diameter of the photosensitive drum 1 is 80 mm, and the photosensitive drum 1 and the transfer drum 5 are synchronously rotated.

A temperature and humidity sensor 503 for detecting the temperature and the humidity is disposed at such a position as not to interfere with the rotational motion of the transfer drum 5, and adjacent the transfer material carrying sheet 50, as shown in FIG. 1, for example. The temperature and humidity sensor 503 serves to detect the temperature and the humidity within the apparatus, and produces voltage signals representative of the detected temperature and humidity. The position of the temperature and humidity sensor is not limited to the position employed by this embodiment, but may be located at another proper position if the temperature and the humidity in the image forming apparatus can be detected.

Figure 2:
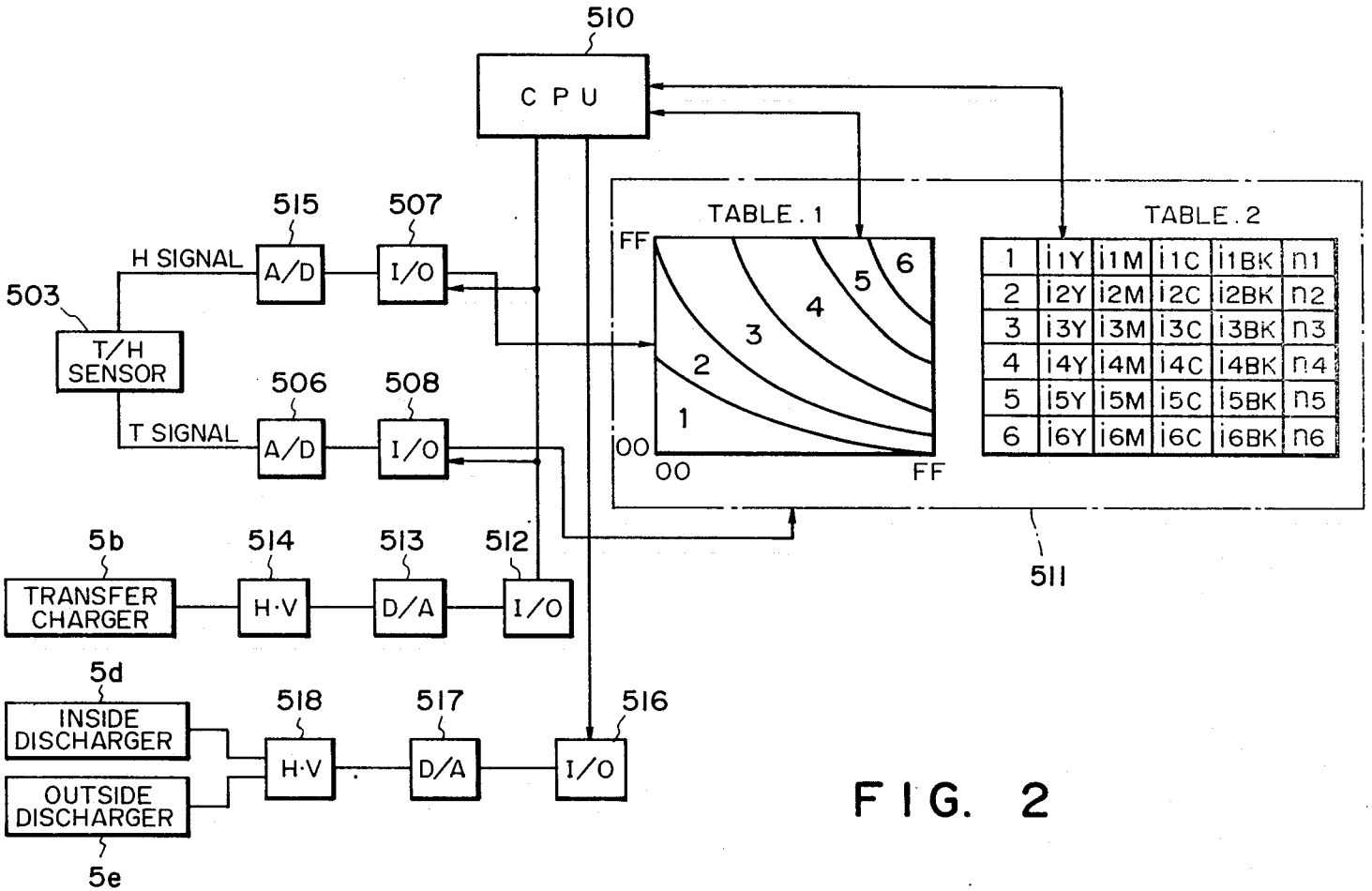
FIG. 2 is a block diagram of a control system usable with FIG. 1 apparatus.
Figure 5:
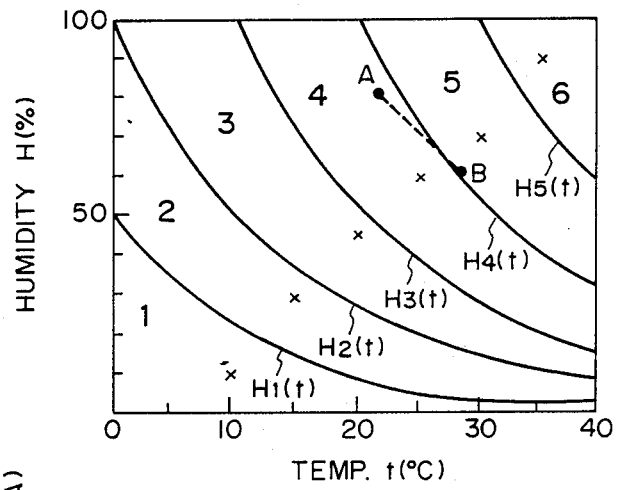
FIG. 5 is a graph showing the relationship between a humidity and a temperature stored in a memory shown in FIG. 2.
Figure 6:
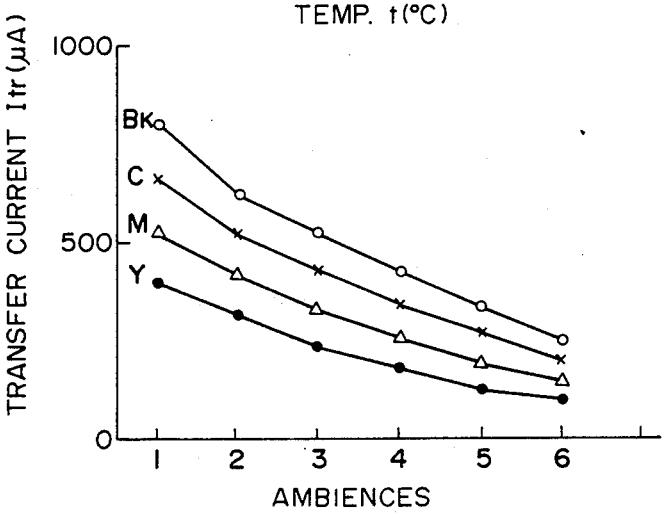
FIG. 6 is a graph showing changes in the transfer currents depending on the ambient conditions for respective color developers.
Figure 8:
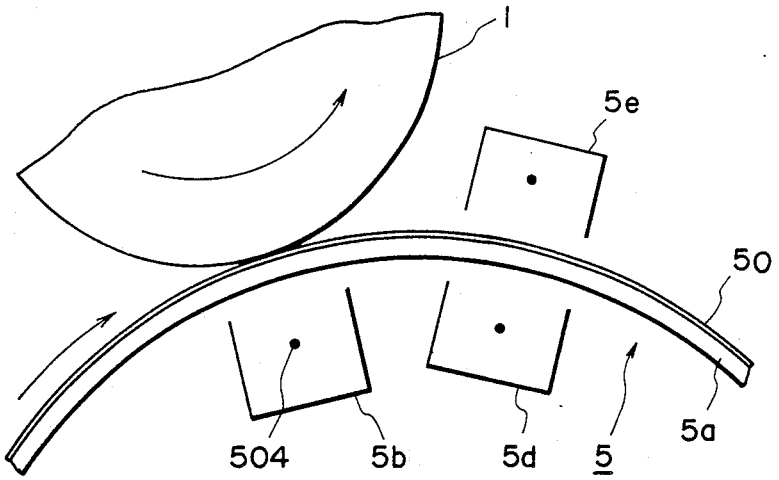
FIG. 8 is a partial sectional view of a conventional image forming apparatus, adjacent the transfer station.

A control system for controlling the entire operation of the multi-color electrophotographic apparatus includes a memory 511 as shown in FIG. 2, which stores beforehand the data as shown in FIG. 5 (Table 1), FIG. 6 and FIG. 7.

Referring to FIG. 5, Table 1 includes areas 1–6 which are defined by plural constant water content curves determined on the basis of temperatures and humidities. Within any one of areas, the ambient conditions are substantially uniform, more particularly, the charging properties of the toner, the charging properties of these the transfer material, the moisture absorbing and charging properties of the transfer material carrying sheet 501 are substantially the same, respectively, within the same area.

Figure 11:
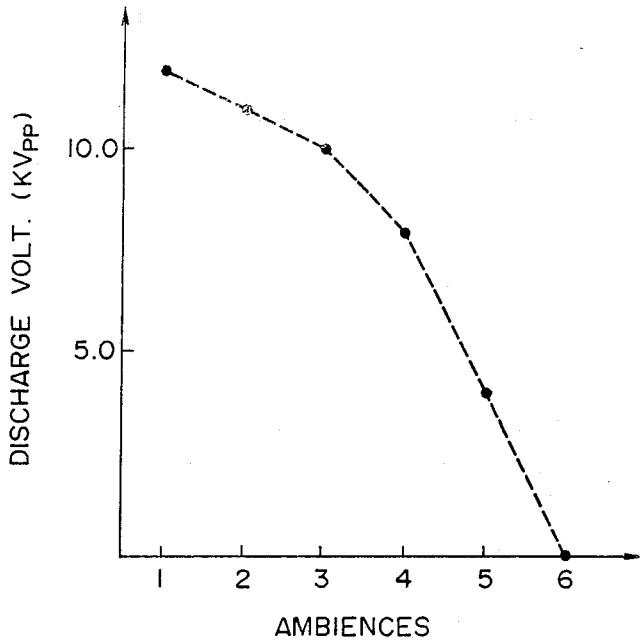
FIG. 11 is a graph of discharge voltage vs. ambient conditions.

Referring to FIG. 7, Table 2 corresponds to the Table 1 having the areas 1–6. More particularly, Table 2 provides for the respective areas the transfer currents $i_Y$, $i_M$, $i_C$ and $i_{BK}$ providing the highest transfer efficient at representative points in the respective regions and discharging voltage n (peak-to-peak) providing good separating operation and good sheet discharging operation for the transfer material and the transfer material carrying sheet. In FIG. 2, however, the representative points are omitted. The representative points are indicated in FIG. 5 by "X". The proper transfer currents for the respective representative points are shown in FIG. 6 in relation to the ambient conditions represented by the areas 1–6. The discharging voltage is determined in consideration of the following. With increase of the temperature and the humidity, the electric resistance of the transfer material and the transfer material carrying sheet 50 decreases, and the electric charge leaks remarkably, and therefore, a strong discharging voltage need not be applied. Therefore, as shown in FIG. 11, a strong discharging voltage is set at the low temperature and low humidity conditions, whereas a weak discharging voltage is set at the high temperature and high humidity conditions. In the ambient conditions defined by the area 6, the transfer material carrying sheet is discharged sufficiently only by the leak of the electric charge, and therefore, it is not necessary to apply the discharging voltage.

The control operation will be described. Referring to FIG. 2, the temperature and humidity sensor 503 provides a detected temperature signal, which will hereinafter be called "T signal", and a detected humidity signal, which will hereinafter be called "H signal". An A/D converter 506 converts the T signal to a digital signal and introduces it to an I/O port 508, whereas an A/D converter 515 converts the H signal to a digital signal and introduces it to I/O port 507. A central processing unit (CPU) 510 reads the signals introduced into the I/O ports 507 and 508 prior to start of the image forming operation of the image forming apparatus, and refers to the Table 1 shown in FIG. 5, and stored in a memory 511, so as to determine which ambient condition area of the areas 1–6 defined by the Table 1 corresponds to the ambient conditions represented by the above signals. Also, CPU 510 refers to the Table 2 as shown in FIG. 7 and stored in the memory 511, so as to read from the Table 2 the transfer current corresponding to the T signal and the H signal.

The transfer current thus read is introduced into a D/A converter 513 through the I/O port 512. The D/A converter 513 the transfer current produced by the CPU 510 converts to an analog signal and transmits it to a high DC voltage source 514, by which the transfer current determined in the above described manner is supplied to the transfer charger **5*b* from the high voltage source 514. Similarly, the discharging voltage is read out of the Table 2, and the read discharging voltage is transmitted to a high AC voltage source 518 through an I/O port 516 and a D/A converter 517, by which the inside discharger 5*d* and the outside discharger 5*e*** are supplied with discharging voltages determined in accordance with the ambient conditions.

As described above, in this embodiment, the ambient conditions are properly determined from the temperature and humidity sensor, and the transfer charger and the dischargers are controlled on the basis thereof, so that the control can meet the variation in the volume resistivity of the transfer material (image receiving material) and the variation in the surface resistance of the transfer material carrying sheet. Therefore, the problems of improper transfer, improper separation and disturbance to the transferred image attributable to the variation in the ambient conditions, can be solved.

Another embodiment will be described, which includes a further improvement. The above-described embodiment is able to solve almost all of the problems described hereinbefore. However, the multi-color electrophotographic apparatus contains therein a heater for heating the heating roller fixing device 9, a drum heater for heating the photosensitive drum 1, and a board having IC (integrated circuit) constituting a control system for controlling the entire apparatus, all of which produce heat. Therefore, with continuing or intermittent image formations after start of the operation of the apparatus, the heat produced by the above heating sources is stored in the apparatus, which remarkably increases the temperature inside the apparatus.

Generally, however, in order to prevent the temperature increase of the inside of the apparatus, a fan is employed to discharge the heat and the air. Therefore, the temperature, the humidity and the amount of water in the air inside the apparatus is almost the same as that outside the apparatus. However, it takes sometime for the amount of the water within the apparatus to become the same as that outside the apparatus, since the apparatus is covered with a casing.

Figure 9:
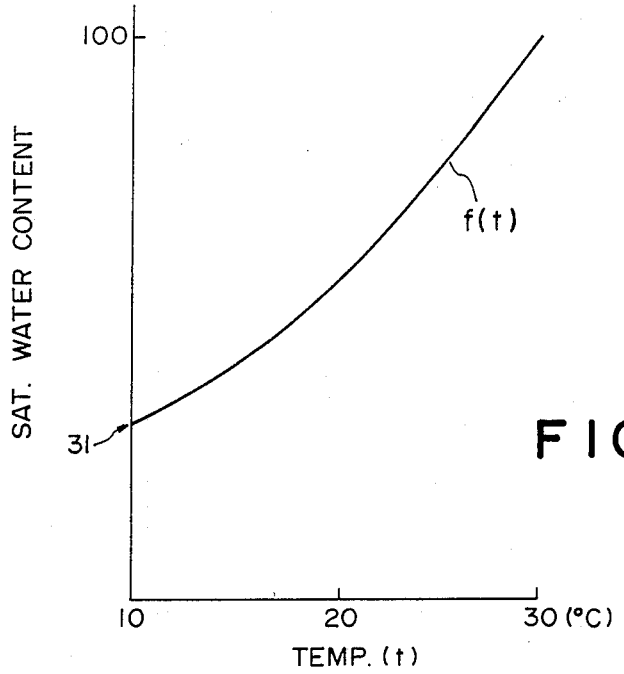
FIG. 9 is a graph of a saturated amount of water content vs. a temperature.
Figure 10:
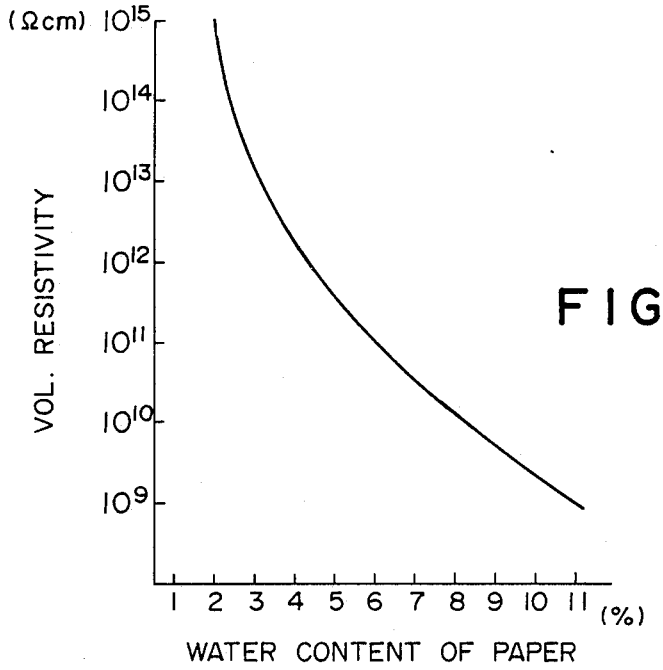
FIG. 10 is a graph of a relationship between the amount of water content of the transfer sheet and the volume resistivity of the transfer sheet.
Figure 12:
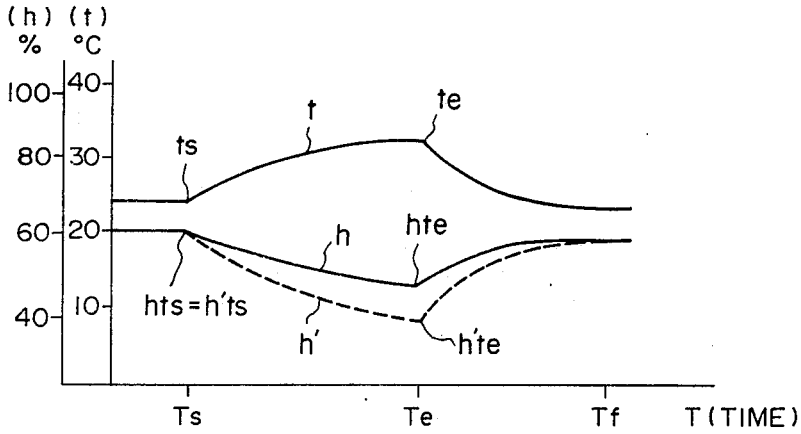
FIG. 12 is a graph of relationships between a time period of image formation and temperature and relative humidity inside the apparatus.

Referring to FIG. 12, there is shown a relationship of the temperature t and the relative humidity h within the apparatus with the time T elapsed, when the image forming apparatus is placed under normal temperature and pressure (23° C., 60%) and is continuously operated for image formation. If the temperature in the apparatus changes as shown by the curve t, the humidity measured by the humidity sensor changes as shown by the curve h' if it is simply considered that the temperature in the apparatus increases. The saturated amount of water at the time of the start (Ts) of the image formation is expressed, using the function f(t) of FIG. 9 and the read $h_{ts}$ of the humidity sensor at that time, as follows:

$$h'_t=(f(ts)h_{ts})/f(t)$$

If $t=t_s$, $h'_{ts}=h_{ts}$. But except at the time of Ts, $h_t>h'_t$ as will be understood from the Figure. This is considered to be attributable to the increase in the relative humidity due to the vapor emitted from the transfer material by the image fixing operation or the like within the apparatus.

On the other hand, the transfer paper is usually disposed outside the apparatus, as shown in FIG. 3 wherein the transfer paper is accommodated in a detachably mountable cassette 7. Therefore, when the transfer sheet is introduced into the apparatus, the vapor is emitted from the transfer sheet by the high temperature ambience or the heating for the image fixing within the apparatus, and as a result, the humidity within the apparatus is increased. The difference between the ambience within the apparatus and the ambience outside the apparatus is significantly different between before and after the continuous or intermittent operation of the apparatus. The ambience within the apparatus becomes high in temperature and humidity.

This will be further described. The ambience within the apparatus (temperature and humidity) at the time when the apparatus starts its operation after the power is supplied, is represented by a point A, for example, in FIG. 5. After a substantial period of time with continuous or intermittent image forming operations from the start of the operation, the ambience within the apparatus changes for the reasons stated above, more particularly, the temperature and the humidity significantly increase, to a point B, for example, in FIG. 5. As will be understood in FIG. 5, the point A is in the area 4, whereas the point B is in the area 5. If the image forming operation is performed with this state maintained, the control system described above automatically extracts the transfer current and the discharge current for the area 5 from the Table 2 shown in FIG. 7 and supplies the transfer means with the transfer current and the discharging means with the discharging voltage (lower than that at the time of the apparatus operation start) determined by the extraction, despite the fact that the state of water content of the transfer sheet has not been changed from that at the start of the operation despite the elapse of substantial time. Therefore, the improper image transfer or the like results when the visualized image formed on the photosensitive drum 1 is transferred onto the transfer sheet.

In this embodiment, when the multi-color electrophotographic apparatus is continuously or intermittently operated for a predetermined period of time after the power supply, the CPU 510 corrects the constant water content curves in the Table 1 shown in FIG. 5 and stored in the memory 511 by shifting the curves so that the humidity values at the same temperatures increases. In other words, the areas 1–6 defined by the constant water content curves (FIG. 5) are corrected to be as shown in FIG. 4.

Figure 4:
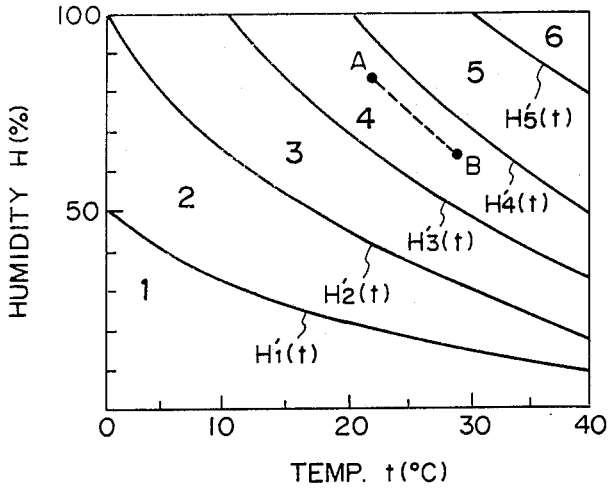
FIG. 4 is a graph of a relationship between a humidity and a temperature which has been by correcting the memory shown in FIG. 2 by the control system provided in the image forming apparatus according to the embodiment of the present invention.

Referring to FIG. 4, there is shown a Table 1 after the constant water content curves are corrected in the memory 511 by the CPU 510. In FIG. 4, the ambience (temperature and humidity) within the apparatus at the time when the power is supplied to the multi-color electrophotographic apparatus, and the copying apparatus starts its operation, is represented by the point A. The point A is at the same coordinates as shown in FIG. 5, and as will be understood, the points A in FIGS. 5 and 4 are both in the area 4. After a substantial period with the continuous or intermittent image forming operation, the temperature and humidity within the apparatus are significantly increased for the reasons stated above, to the point B, for example. The point B is at the same coordinates as the point B shown in FIG. 5, but the point B in FIG. 4 is in the area 4, not the area 5 as in FIG. 5. Therefore, even if a substantial period of time elapses after the start of the operation with the result that the temperature and the humidity within the apparatus increase, the point B is kept within the area 4 which substantially meets the water content in the transfer sheet outside the apparatus, as contrasted to the case where the Table 1 of FIG. 5 is used, since the CPU 510 shifts the constant water content curves to provide a higher humidity at the same temperature. In this manner, even after a substantial period elapses after the start of the operation of the apparatus, the image transfer action and the discharging action can be performed with the transfer current and the discharging voltage levels corresponding to the representative point within the area 4 as indicated by "X" in FIG. 5 determined at the time when the apparatus starts its operation, and therefore, improper image transfer or the like can be prevented, and the high quality image can be maintained.

Referring to FIG. 12, the method of correction to be described in detail. Taking as an example the time of image forming operation termination Te (temperature is $t_e$), the increase Δ of the water content within the apparatus is:

$$\Delta=(f(t_e)h_{te}-f(ts)\ h_{ts})\times 1/100$$

The increase in the relative humidity at the temperature $t_e$ is $\Delta/t(t_e)$, that is, $$\Delta/f(t_e) \text{ or } h_{te}-f(ts)h_{ts}/f(t_e)$$

Those can be generalized as a function of t which is a temperature within the apparatus when the time T ($Ts<T<Te$) elapses after the start of the image forming operation, by substituting the temperature t for the temperature $t_e$.

In other words, the increase in the relative humidity at the time when the temperature is t, is:

$$\Delta/f(t)=h_t-f(ts)h_{ts}/f(t)$$

Then, the constant water content curves shown in FIG. 5 Hn(t) where n=1–5, and t is a temperature, are corrected to be as follows:

$$Hn(t)+\Delta/f(t)$$

or $$Hn(t)+\{h_t-f(ts)h_{ts}/f(t)\}$$

By this correction, the curves Hn(t) is corrected to H'n(t) which are the curves shown in FIG. 4.

After the termination of the image forming operation Te, the factors contributable to increasing the humidity within the apparatus, and the air within the apparatus is discharged to the outside by a discharging fan, which leads to introduction of the outside air into the apparatus, the temperature and the humidity within the apparatus approaches those of the outside ambience. This is shown in FIG. 12 as Tf.

Therefore, after the time (Tf−Te) elapses, the above-described correction is made again, starting the temperature and the humidity at that time. If the next image formation is started before the time (Tf−Te) elapses, the correction is made, starting the amount of the water $f(t_s)h_{ts}$ determined for the time Ts in FIG. 12. Since the time period (Tf−Te) is dependent on the air discharging power of the apparatus, it is desirably determined for individual models of the machines.

As described, the constant water content curves are corrected properly depending on the situation. As for the method of correcting the constant water content curves shown in Table 1 of FIG. 5 so as to provide an increased humidity for the same temperature, there are other methods. For example, another memory is provided in addition to the memory 511 in the apparatus and stores a table or tables for a number of constant water content curve data depending on various studies and experiments: and the CPU 510 selects a proper table from the additional memory in accordance with the variation in the ambience within the apparatus; and the transfer current and the discharging voltage are determined on the basis thereof. Alternatively, a proper equation for the correction is stored in the memory 511; and the CPU 510 corrects the constant water content curves of the Table 1 stored in the memory 511, using the equation.

As described in the foregoing, according to this embodiment, even if an image is formed by the apparatus after a substantial period of time elapses with continuous or intermittent image forming operations from the start of the image forming operation when the power source is supplied, the image can be transferred in good order, and therefore, high quality images can be provided.

In the foregoing embodiment, the dischargers have been described as being supplied with an AC voltage, but they may be supplied with a DC voltage or a combined DC and AC voltage. Also, in the foregoing embodiments, the voltages of the dischargers are controlled, but discharging currents in place thereof may be controlled. As for the transfer charger, the transfer voltage level may be controlled in place of the transfer current.

Also, in the foregoing embodiments, plural images are formed on one image bearing member and are transferred onto the same transfer material superimposedly. However, the present invention is applicable to the system wherein plural image bearing members are used for the respective colors, i.e., yellow, magenta, cyan and black colors, and the corresponding number of image transfer stations are established for the respective image bearing members; the transfer material is conveyed through the respective transfer stations by which the respective color images are transferred superimposedly on the same transfer material.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

movable image bearing means;

means for sequentially forming on said image bearing means images corresponding to different color information;

means for transferring onto an image receiving material the images formed on said image bearing means;

image receiving material carrying means for carrying and conveying the image receiving material to an image transfer station where said image bearing means and said transfer means are opposed, wherein the images formed on the image bearing means are sequentially transferred superimposedly onto the image receiving material at the transfer station;

discharging means disposed downstream of said image transfer means with respect to the movement direction of said image receiving material carrying means;

means for detecting a temperature and a humidity within said image forming apparatus; and control means for controlling outputs of said image transfer means and said discharging means on the basis of output from said detecting means and predetermined data.

2. An apparatus according to claim 1, wherein said image receiving material carrying means includes a dielectric member for carrying the image receiving material, and is movable along an endless path.

3. An apparatus according to claim 2, wherein said discharging means is operable when the image receiving material carried on said image receiving material carrying means is separated from said image receiving material carrying means.

4. An apparatus according to claim 3, wherein said discharging means includes a couple of dischargers opposed to each other with the dielectric member of said image receiving material carrying means interposed therebetween.

5. An apparatus according to claim 1, wherein the output of said image transfer means increases with the number of image transfer operations performed for different color images to be superimposed.

6. An apparatus according to claim 5, wherein a transfer current by said transferring means increases gradually.

7. An apparatus according to claim 1, an ambience in the apparatus is determined by selection from plural areas defined by constant water content curves predetermined on the basis of temperatures and humidities, in response to the temperature and the humidity detected by said detecting means.

8. An apparatus according to claim 7, wherein the outputs of said image transfer means and said discharging means are predetermined for the respective areas.

9. An apparatus according to claim 7, wherein an ambience in the apparatus is determined by selection from corrected plural areas provided by correcting aforementioned plural areas defined by constant water content curves predetermined on the basis of temperatures and humidities so as to increase the humidity at the same temperature, in response to the temperature and the humidity detected by said detecting means.

10. An apparatus according to claim 9, wherein the outputs of said image transfer means and said discharging means corresponding to each of the areas after correction correspond to the outputs of said image transfer means and said discharging means corresponding to each of the areas before correction.

11. An apparatus according to claim 7 or 10, wherein the determination of the ambience is effected after a predetermined period of time elapses with continuous or intermittent image forming operations of said image forming apparatus.

12. An apparatus according to claim 1, wherein said image transfer means and said discharging means includes corona discharger means.

13. An apparatus according to claim 12, wherein said image transfer means includes a DC corona discharger, and said discharging means includes an AC corona discharger.

14. An apparatus according to claim 1, wherein said image forming means includes plural developing devices containing at least yellow developer, magenta developer and cyan developer.

15. An apparatus according to claim 1, wherein said image receiving material is of paper.

16. An apparatus according to claim 2, wherein said discharging means includes a pair of dischargers opposed to each other with the dielectric member of said image receiving material carrying means interposed therebetween, wherein said pair of dischargers are supplied with AC voltages having opposite phases.

17. An apparatus according to claim 1, wherein said discharging means is supplied with a combined AC and DC voltage.

18. An apparatus according to claim 3, wherein said discharging means is disposed between said image transfer means and separating means for separating the image receiving material from said image receiving material carrying means.

19. An apparatus according to claim 2, wherein said image receiving material carrying means includes a cylinder having an opening which is covered by said dielectric member.

20. An apparatus according to claim 1, wherein the output of said image transfer means is decreased with increase of temperature and humidity.

* * * * *

UNITED STATES PATENT AND TRADEMARK OFFICE

CERTIFICATE OF CORRECTION

PATENT NO. : 4,912,515

DATED : March 27, 1990

INVENTOR(S) : KOJI AMEMIYA ET AL.

It is certified that error appears in the above-identified patent and that said Letters Patent is hereby corrected as shown below: Title page:

AT [56] REFERENCES CITED

Foreign Patent Documents, insert
--2082349 3/1982 United Kingdom--.

AT [57] ABSTRACT

Line 14, "movement detection" should read
--movement direction--.

COLUMN 1

Line 5, "No. 216120" should read --No. 216,120--.
Line 44, "columnai" should read --columnar--.
Line 60, "cut away" shoud read --cut-away--.

COLUMN 2

Line 10, "to" should read --for--.
Line 34, "yellow developer 4Y," should read
--yellow developing device 4Y,--.

COLUMN 3

Line 11, "photosensi-" should be deleted.
Line 12, "tive drum 5" should read --transfer drum 5--.
Line 35, "increased," should read --increased--.
Line 47, "operation." should read --operations.--.

COLUMN 4

Line 6, "property" should read --properly--.
Line 21, "produces" should read --produce--.

UNITED STATES PATENT AND TRADEMARK OFFICE

CERTIFICATE OF CORRECTION

PATENT NO. : 4,912,515

DATED : March 27, 1990

INVENTOR(S) : KOJI AMEMIYA ET AL.

It is certified that error appears in the above-identified patent and that said Letters Patent is hereby corrected as shown below:

COLUMN 5

Line 7, "separated" should read --separates--.
Line 52, "by correcting" should read --corrected by--.

COLUMN 6

Line 14, "Although," should read --Although--.
Line 68, "areas," should read --these areas,--.

COLUMN 7

Line 2, "these" should be deleted
Line 10, "efficient" should read --efficiency--.
Line 57, "converter 513 the" should read --converter 513 converts the--.
Line 58, "converts" should be deleted.

COLUMN 8

Line 31, "sometime" should read --some time--.

COLUMN 9

Line 36, "creases." should read --crease.--.

COLUMN 10

Line 6, "to" should read --will--.
Line 38, "is" should read --are--.

UNITED STATES PATENT AND TRADEMARK OFFICE

CERTIFICATE OF CORRECTION

PATENT NO. : 4,912,515

DATED : March 27, 1990

INVENTOR(S) : KOJI AMEMIYA ET AL.

It is certified that error appears in the above-identified patent and that said Letters Patent is hereby corrected as shown below:

COLUMN 12

Line 22, "claim 1, an" should read --claim 1, wherein an--.

Line 52, "cludes" should read --clude--.

Signed and Sealed this

Ninth Day of April, 1991

*Attest:*

*Attesting Officer*

HARRY F. MANBECK, JR.

*Commissioner of Patents and Trademarks*